US009108834B2

(12) United States Patent
Mauro et al.

(10) Patent No.: US 9,108,834 B2
(45) **Date of Patent: *Aug. 18, 2015**

(54) HOT FILLING SYSTEM FOR BOTTLES

(75) Inventors: Pasquale Mauro, Parma (IT); Stefano Abati, Felino (IT); Matteo Zoppas, Conegliano (IT)

(73) Assignee: S.I.P.A. Societa' Industrializzazione Progettazione E. Automazione S.p.A., Vittorio Veneto (IT)

( * ) Notice: Subject to any disclaimer, the term of this patent is extended or adjusted under 35 U.S.C. 154(b) by 848 days.

This patent is subject to a terminal disclaimer.

(21) Appl. No.: 13/138,401

(22) PCT Filed: Feb. 15, 2010

(86) PCT No.: PCT/IB2010/050667

§ 371 (c)(1),
(2), (4) Date: Aug. 11, 2011

(87) PCT Pub. No.: WO2010/097730

PCT Pub. Date: Sep. 2, 2010

(65) Prior Publication Data

US 2011/0303324 A1 Dec. 15, 2011

(30) Foreign Application Priority Data

Feb. 13, 2009 (IT) ..... RM2009A0066

(51) Int. Cl.
*B65B 1/30* (2006.01)
*B67C 3/04* (2006.01)
(Continued)

(52) U.S. Cl.
CPC ..... *B67C 3/045* (2013.01); *B67C 3/281* (2013.01); *B67C 2003/2671* (2013.01)

(58) Field of Classification Search
CPC .. B67C 3/045; B67C 3/281; B67C 2003/2671
USPC ..... 141/11, 120, 323, 59, 82, 302, 290; 222/424
See application file for complete search history.

(56) References Cited

U.S. PATENT DOCUMENTS 3,500,879 A 3/1970 Meyer
3,757,835 A 9/1973 Copping
(Continued)

FOREIGN PATENT DOCUMENTS

DE 1184233 12/1964
DE 20105716 * 5/2002 ..... B67C 3/00
(Continued)

*Primary Examiner* — Jason K Niesz
(74) *Attorney, Agent, or Firm* — Stetina Brunda Garred & Brucker

(57) ABSTRACT

A filling valve (1) for hot filling plastic bottles, which allows to meet all the requirements determined by the typical particularities of hot filling applications in the most effective manner possible, while allowing to maintain the same basic configuration also for cold processing plain liquids without needing recirculation, e.g. plain water. The filing valve (1) comprises:—a valve body (2) defining therein a space for the passage of a filing liquid and provided with a hole for introducing said liquid in one of said containers,—a first shutter (4) of said hole, sliding within the valve body (2), a siphon (5) between said space and said hole, and a liquid deflection element (6) accommodated in said hole, configured so as to confer a rotational component to the liquid which crosses it, which permits the liquid itself to adhere to the walls of the container during the step of filing, said deflection element (6) being integrally fixed to and directly in contact with said first end of the first shutter (4).

14 Claims, 12 Drawing Sheets

(51) Int. Cl.
*B67C 3/28* (2006.01)
*B67C 3/26* (2006.01)

(56) References Cited

U.S. PATENT DOCUMENTS 4,711,276 A 12/1987 Simonazzi
5,156,200 A * 10/1992 Mette ..... 141/46
6,135,167 A * 10/2000 Kiholm ..... 141/59
7,350,545 B2 * 4/2008 Ruble et al. ..... 141/147
8,443,850 B2 * 5/2013 Sollner et al. ..... 141/82

FOREIGN PATENT DOCUMENTS

FR 1371972 9/1964
FR 1595981 6/1970
WO WO2008116564 10/2008
WO WO2008141717 11/2008

* cited by examiner

HOT FILLING SYSTEM FOR BOTTLES

FIELD OF THE INVENTION

The present invention relates to a bottle filling valve, particularly adapted to hot fill plastic bottles with alimentary liquids, such as fruit juice, isotonic beverages, milk and other similar beverages, and to a corresponding system comprising a plurality of filling valves.

STATE OF THE ART

In order to ensure the preservation and safety of beverages or, in general, of foodstuff in the liquid form subjected to microbiological deterioration, such as milk, wine, beer, juice, tea, etc., a pasteurization process is generally applied, which consists in heating the foodstuff in order to reduce or suppress the presence of certain microorganisms. In the case of fruit juice, tea or isotonic beverages, one of the most common methods for avoiding the pasteurized beverage from being contaminated again before packaging is to fill the containers while maintaining the beverage itself over a certain temperature. Such a temperature depends on the type of product and duration of the treatment itself. Once the container has been sealed, the foodstuff is then allowed to cool. Furthermore, when the hot filling process is carried out using PET bottles, it has some particularities which require the solution of some specific problems.

A first problem to be solved consists in heating each filling valve along with the filling system before starting the filling process to avoid the product from cooling down, which would compromise the effectiveness of the thermal treatment cycle. In known filling systems, such a step of pre-heating occurs by activating an appropriate recirculation circuit, first by circulating hot water and then circulating the hot foodstuff which is sent to a recovery circuit without ending up in the bottle. A transitional step of recirculating the flow, called in-valve recirculation step, is thus contemplated in these cases.

A second problem to be solved is that of upturning the bottle for a few seconds immediately after closing the cap in order to make the beverage, which is still hot, lap on the internal surfaces of the cap and neck of the bottle which emerge from the liquid, the so-called "head space", thus subjecting them to a thermal treatment which is the more effective the smaller the extension of such surfaces. For this reason, a high level is normally required in the bottle after filling, which level is often not reachable by the deflection systems of the prior art.

A third problem is related to the fact that the filling process of several products, particularly at high temperature, tends to cause the formation of foam. Such a foam should be removed before capping because it will dissolve once the container has been closed, thus causing an undesired lowering of the level. It is therefore needed to provide for a so-called step of "in-bottle recirculation" after the step of filling, during which the upper portion of the product, already introduced into the bottle, is caused to flow out along with the foam which has risen to the surface and is replaced by new product which enters into the bottle at a low flow rate, without generating any turbulence and new foam.

Another problem is that during extended machine stops, the step of in-valve recirculation should be activated both to avoid the system from cooling down, in particular the product close to the closed valves waiting for being bottled, and the step of in-bottle recirculating to avoid the product in the previously filled bottles from cooling down before capping, which event would cause the bottles to be rejected.

Both during the step of pre-heating and the productive step of filling, the in-bottle or in-valve recirculated product is advantageously recovered, cooled and introduced into a tank, from where it is gradually disposed of by adding a percentage of new product to be pasteurized. This percentage of product which is subjected to a second pasteurization should be maintained at values as low as possible to prevent decaying the organoleptic features of the final beverage. A system needs therefore to be adopted for monitoring the amount of liquid recirculated in the bottle in order to minimize the amount according to the type of product, the type of bottle and the production frequency each time.

In the frequent case of bottles with a small diameter neck, the passing section made available for filling and for evacuating foams is limited. Filling systems with recirculation of the prior art are based on the use of "internal recirculation" beaks, which generate a series of problems because:

a) they further reduce the active sections thus requiring a certain thrust, i.e. the piezo load, which causes undesired strains on the plastic bottle, b) they do not allow an optimal deflection which generates foam, c) they do not allow rapid foam evacuation, which causes a high percentage of recirculating product, d) they penetrate into the bottle and remain submerged in the liquid at the end of filling, whereby the level decreases when the beak is extracted, which is an undesirable effect.

Another important problem is that the market increasingly requires more 100% fruit juice or fruit-based beverages containing a given amount of pulps, filaments or cells which confer particular features of "naturalness" to the beverage. The presence of pulps in the beverage is detrimental to the recirculation control systems traditionally based on calibrated orifices. Furthermore, if the filling process causes excessive turbulence, the pulp tends to incorporate an amount of foam which does not rapidly rise to the surface and which may be removed only by means of a very long step of recirculating which causes, as mentioned above, a large amount of recovered product and a deterioration of the organoleptic features of the product.

The use of new materials is becoming increasingly more widespread today because the modern blowing technologies allow to obtain plastic bottles, typically made of PET, polyethylene terephthalate, at the same time suitable for hot filling up to 95° C. and sufficiently resistant although obtained by using increasingly smaller amounts of material. It is important that the filling process does not subject the container to pressures or strains which may compromise the dimensional stability thereof, as high temperature tends to reduce its strength.

When the solution of making the nozzles and deflection systems penetrate into the bottle is used in order to optimize the foodstuff flow, these being partially submerged in the liquid at the end of filling to then emerge during the step of detaching from the bottle, problems of product spillage may easily occur, with consequent fouling of the mouth exterior and subsequent formation of mould in the gaps between capsule and bottle, or particularly in the case of small diameter necks, problems of final level lowering caused by the emersion of these parts may occur.

Moreover, particularly with large diameter bottle mouths, it is important to move the container without knocking it and without making it follow paths with sudden ups and downs or in all cases without curvature radiuses generating high centrifugal components, so that no product is spilled during the transfer of filled containers which are still uncapped because the distance between the upper surface of the liquid and the upper edge of the neck of the container is minimal.

Today, the adoption of fully mechanical filling systems instead of electronically controlled systems is desirable because a hot filling machine is a basically "hostile" environment for cables, boards and electronic components in general due to the high temperature and to intensive, frequent washing needed to remove product deposits caused by splashes and vapors. The use of electronic components aboard the machine would also require the adoption of covering boxes and protective metal sheets with the creation of unwashable shielded areas.

Furthermore, the parts above the bottle should preferably be as free as possible of gaps and hidden points which are difficult to be washed, or sliding elements such as bushings and seals which, being subject to wear, leave deposits and residues. Indeed, the liquid present on these surfaces due to the formation of condensations or caused by jets of water which are needed to wash or lubricate some parts could drip into the open bottles transiting under the open valve when entering and existing in/from the filling roundabout.

It is thus felt the need to implement a bottle filling system which allows to overcome the aforesaid drawbacks.

SUMMARY OF THE INVENTION

It is an object of the present invention to provide a bottle filling valve which allow to meet all the requirements determined by the typical peculiarities of hot filling applications in the most effective manner possible, while allowing to maintain the same basic configuration also for cold processing plain liquids without recirculation needs, e.g. plain water.

It is a further object of the invention to provide a bottle filling method which allows to overcome all the mentioned drawbacks of the prior art by means of the aforesaid filling valve.

The present invention thus suggests to achieve the above-discussed objects by implementing a filling valve for filling containers which in accordance with claim 1 comprises:

a valve body defining therein a space for the passage of a filling liquid and provided with a hole for introducing said liquid into one of said containers, a first shutter of said hole, sliding within the valve body, wherein said first shutter is provided with a sealing element at a first end thereof, which is suited to fluid-tightly close the hole and configured so as to define, in cooperation with a bottom of the valve body, a siphon between said space and said hole, and wherein a liquid deflection element is accommodated in said hole, configured so as to confer a rotational component to the liquid which crosses it, which permits the liquid itself to adhere to the walls of the container during the step of filling, said deflection element being integrally fixed to and directly in contact with said first end of the first shutter.

A second aspect of the present invention provides for a method of filling a container with a filling liquid by means of the aforesaid filling valve which in accordance with claim 15 comprises the steps of:

heating the valve body of the filling valve by means of a passage in the space of said valve body firstly of hot water and then of filling liquid at a predetermined temperature, maintaining the second shutter in opening position and the first shutter in closing position;

taking the second shutter to closing position;

taking the first shutter to opening position and filling the container with the filling liquid to reach a bottled liquid volume corresponding to a level determined by the position of the inlet section of the evacuation pipe, with a consequent evacuation of air through said evacuation pipe;

further filling the container so as to recirculate the filling liquid in the container with a consequent evacuation of a portion of said bottled liquid volume through the evacuation pipe;

taking the first shutter to a closing position at a predetermined instant so that said volume portion is equal to no more than 10% of the bottled liquid volume.

The system of the invention advantageously provides for the presence of a drainable siphon, so as to avoid undesired stagnations of liquid by virtue of the internal recirculation valve which, being arranged in an appropriate position, allows to completely empty the siphon.

Furthermore, the deflection system within the filling valve body is shaped so that it does not get obstructed when filling with products containing pulps. The deflection system advantageously has a series of passages for orienting the product flow thus conferring a centrifugal component thereto, which is sufficient to ensure the liquid adherence to the bottle walls, thus overcoming the edges within the profile of the bottle itself.

A further advantage is offered by including a pneumatic actuator of the main shutter of the filling valve inside the body of the moving carriage thus avoiding possible leakage of compressed air from coming in contact with the product to be bottled.

The connection between the main shutter of the filling valve and the corresponding actuator is simple from the constructional point of view, because it include a few, simple parts, and further allows easy maintenance by virtue of the disconnection ease between the aforesaid two components, while ensuring the total separation between pneumatic body and product passage channels for hygienic reasons.

Due to the combination of features of the filling system of the invention many advantages are obtained with respect to the filling systems of the prior art:

the filling system is able to process beverages containing pulps, filaments and cells;

it allows filling at a higher flow rate with better cost saving related to the consequent reduction of the machine size, it allows to reach higher filling levels of the containers, especially with small diameter necks, it allows to reduce the amount of recirculated product, with consequent improvement of the final product quality, the piezo load or filling pressure is also reduced, thus the pressure in the bottle is also reduced, allowing to work with lighter bottles.

Finally, the system combines a simplification of the components with a reduction of structure costs (valve area, controls, faucet cam, base) in addition to improving cleaning inside and outside and improving the performance of the actuating system.

The dependent claims describe preferred embodiments of the invention.

BRIEF DESCRIPTION OF THE DRAWINGS

Further features and advantages of the invention will be more apparent in the light of the detailed description of a preferred, but not exclusive, embodiment of a bottle filling system illustrated by way of non-limitative example, with the aid of the accompanying drawings, in which.

DETAILED DESCRIPTION OF A PREFERRED EMBODIMENT OF THE INVENTION

Figure 1:
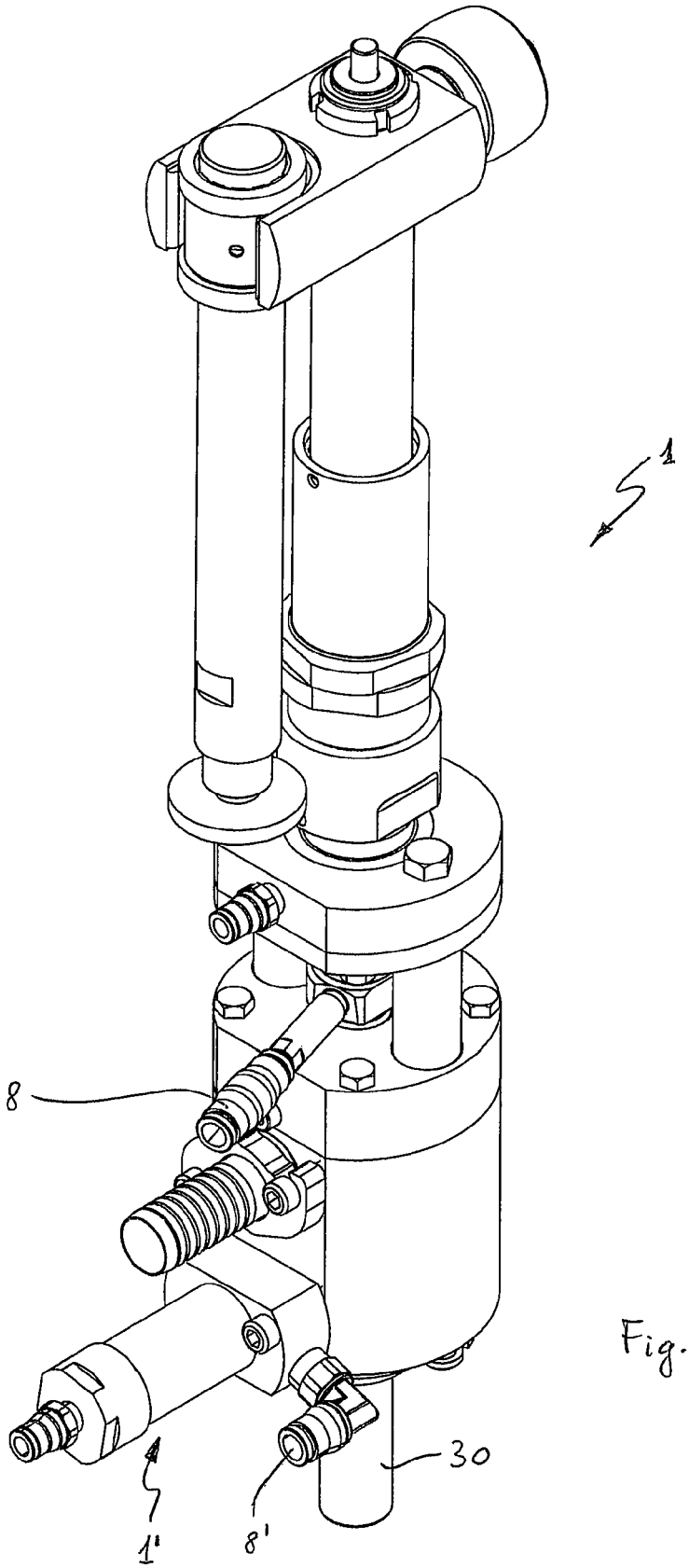
FIG. 1 is a perspective view of a filling valve according to the invention.
Figure 2:
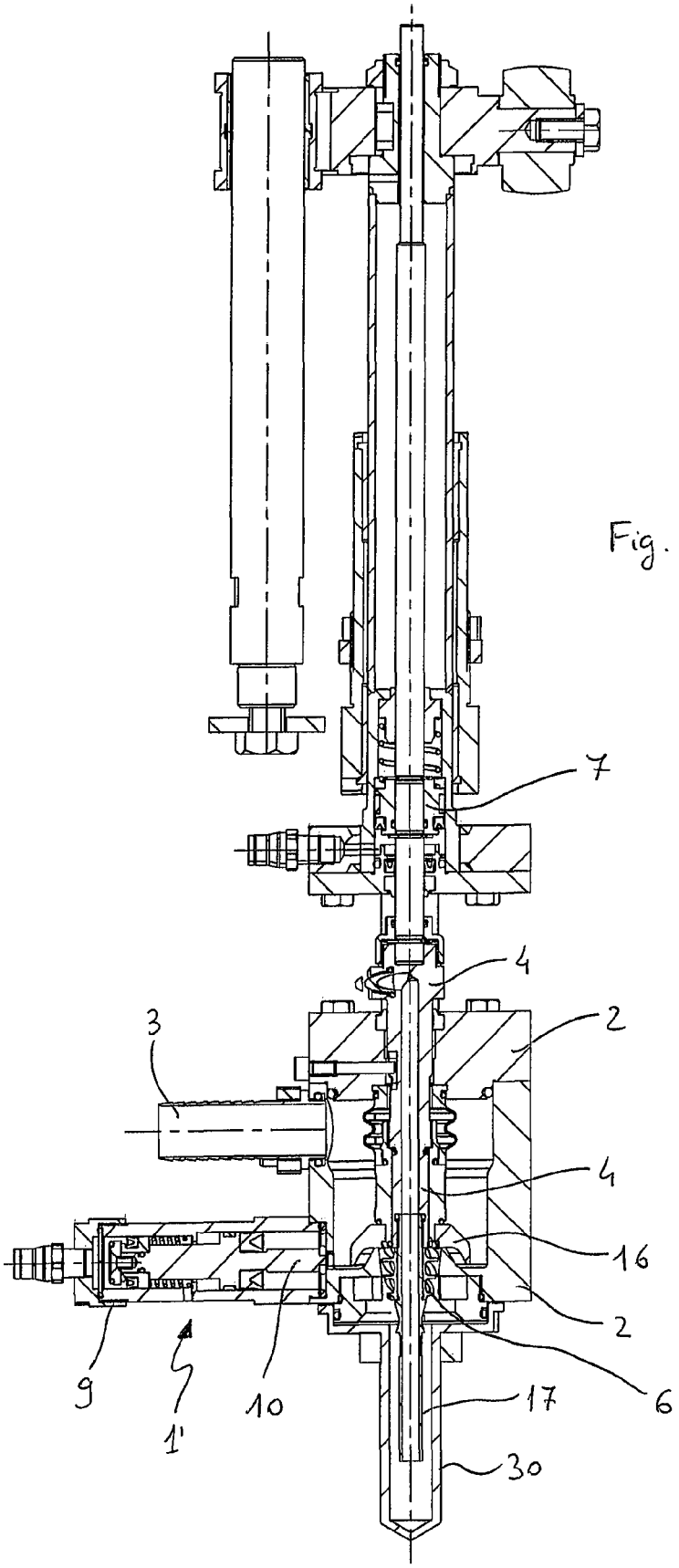
FIG. 2 is a first section view of a filling valve according to the invention.

With particular reference to FIG. 1, the filling valve of the invention is suited to hot fill (up to 95° C.) PET bottles with low viscosity beverages (kinematic viscosity <20 cSt) containing pulps having a maximum size of Ø=3×L=5 or filaments having a maximum size of Ø=1×L=10 (some examples of beverages responding to the indicated requirements are: tea, Gatorade and isotonic beverages, soy sauce, soy milk, balsamic vinegar, 50% peach/apple/pear/banana nectar, pineapple juice, vitamin beverages such as ACE, apple juices or 100% citrus fruit juices). The bottles sizes may be from 100 and 3500 ml in size and have mouths with external diameter from 28 to 38 mm and internal diameter to a minimum of 17 mm.

The aforesaid filling valve, indicated as a whole by numeral 1 in FIG. 1, comprises:

- a carriage 11 for vertically moving the valve, which allows a smooth movement thereof, while limiting the number of sliding contacts and the extension of wet surfaces which could drip into the bottle;
- a valve body 2 to which the filling liquid is fed through a flexible pipe 3;
- a first shutter 4, accommodated within said valve body 2, comprising a control stem 15 and, at the lower end of the latter, a sealing element 16 made of elastomeric or other suitable material adapted to adhere to the internal bottom of the valve body 2;
- a siphon 5 for controlling the filling level, defined by the internal bottom of the valve body 2 and the sealing element 16;
- an in-valve deflection system 6 which allows the flow from the valve body 2 to the bottle without turbulences and without introducing deflection elements into the bottle itself;
- a pneumatic actuator 7, integrated in carriage 11, which allows the product shutter 4 to be opened, controlled by means of a pneumatic exchanger (not shown) actuated by fixed cams outside the filling roundabout;
- an evacuation pipe 8, integrated in shutter 4, used for evacuating the air contained in the bottle during the step of filling and for recirculating the liquid at the end of the step of filling (step of evacuating foam or maintaining temperature);
- a recirculation valve 1' comprising a second shutter 9, with corresponding pneumatic actuator 10, engaged on the main valve body 2, with the two-fold function of allowing in-valve recirculation during the steps of preheating and maintaining the temperature when the machine is stopped, and of completely draining the siphon 5 inside the valve at the end of the internal washing procedures.

Arranging the pneumatic actuator 7 of the main shutter 4 of the filling valve inside the moving carriage 11 avoids possible leakage of compressed air from coming in contact with the product to be bottled, because the actuation part of the filling valve, comprising the actuator 7, and the processing part of the valve itself comprising the shutter 4, i.e. the part in which the liquid to be bottled flows, are physically separate and connected by means of simple fastening means, such as a ring nut and two screws, for example.

Siphon 5 for controlling the filling level of the bottles is actuated by actuator 7 which lifts or lowers the shutter 4 and thus the sealing element 16 integral therewith. This sealing element 16 is substantially hat-shaped. The bottom of the valve body 2 is provided with an annular protrusion 19 which defines the siphon 5, in cooperation with the sealing element 16.

The deflection system 6 for deflecting the liquid in the valve advantageously comprises a swirler, comprising a plurality of helical pipes 13 so as to confer a rotational component to the liquid which crosses them, which allows the liquid itself to adhere to the bottle walls during the step of filling, making the latter faster and causing less formation of foam.

Figure 5:
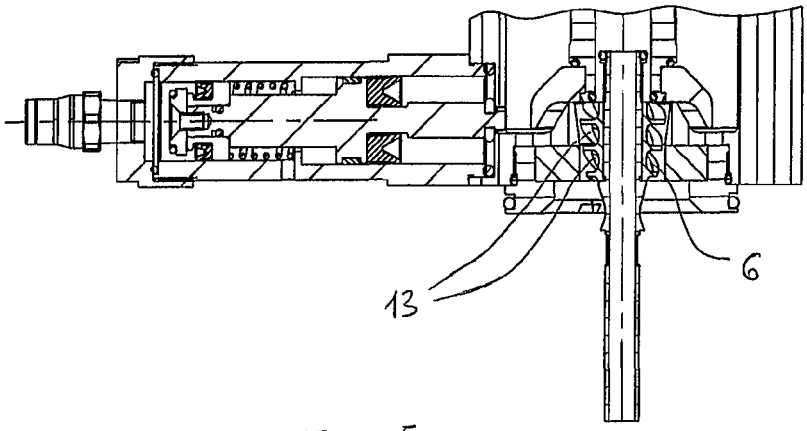
FIG. 5 is a partial section view which shows a first variant of a first component.
Figure 6:
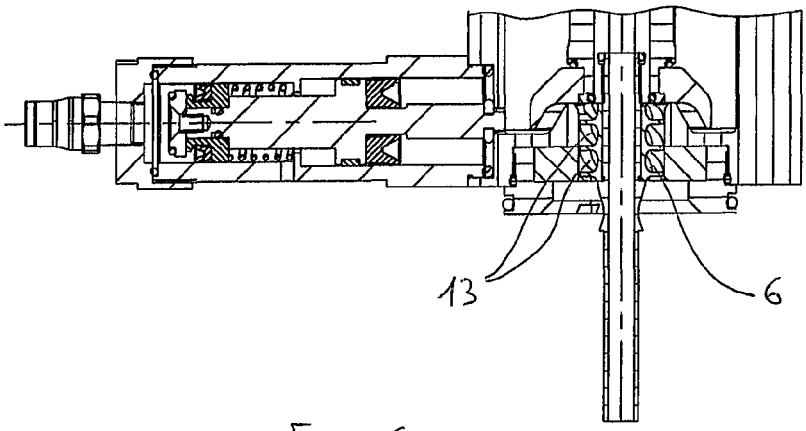
FIG. 6 is a partial section view which shows a second variant of said first component.

Swirler 6 may have an external cylindrical envelope (FIG. 6) or it may have a conical external envelope (FIG. 5) preferably when products with pulps, cells or filaments are processed.

In a first embodiment, the conical configuration of the swirler 6 inside a conical, frustoconical or frustoconocal-cylindrical hole, i.e. constituted by a first frustoconical part followed in the vertical direction by a second cylindrical part (FIG. 5), allows to increase the available passage section for the product when the main shutter 4 of the valve opens, thus minimizing the likelihood of obstruction due to the passage of pulps contained in the liquid.

In a second embodiment, the cylindrical configuration of the swirler 6 inside a cylindrical hole (FIG. 6) is useful in that the swirler may be disassembled from the valve by removing it from the bottom, by simply unscrewing the tubular element or beak 17 on which it is mounted. In the case of clear products, this allows to mount a beak with a traditional deflector, if the machine needs to also process cold products at a higher output speed, provided that the product level in the bottle allows this circumstance.

Figure 6D:
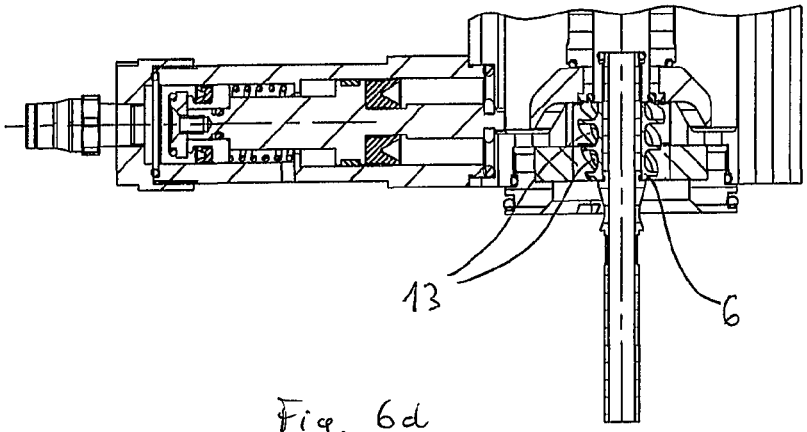
FIG. 6*d* shows a partial section view of a third variant of the first component.
Figure 5B:
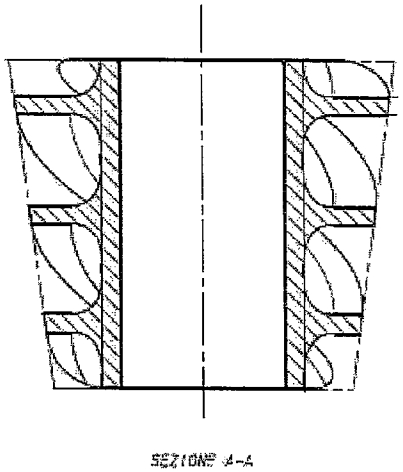
FIGS. 5*a*, 5*b* and 5*c* show side, section and top views of said first variant, respectively.
Figure 5A:
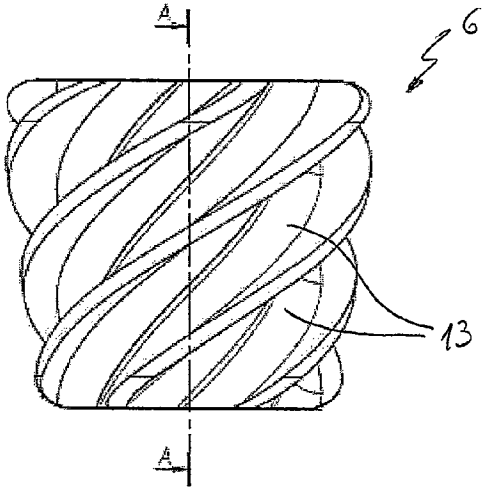
Figure 5C:
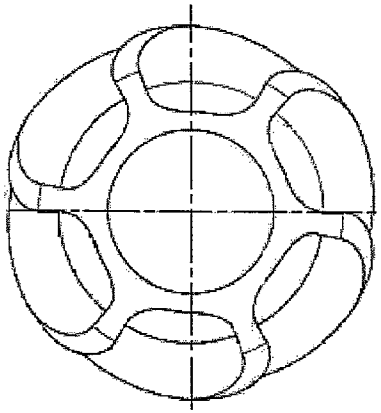
Figure 6B:
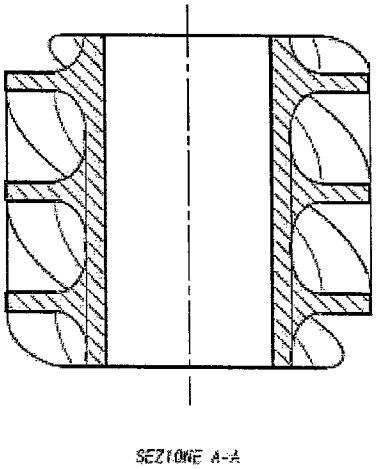
FIGS. 6*a*, 6*b* and 6*c* show side, section and top views of said second variant, respectively.
Figure 6A:
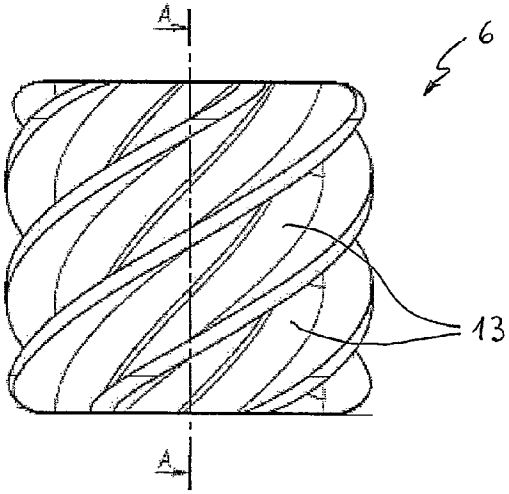
Figure 6C:
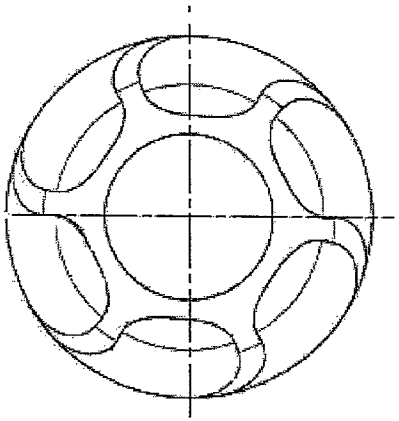

In a third embodiment, the conical configuration of the swirler 6 inside a cylindrical hole (FIG. 6*d*) has the same advantage of the cylindrical configuration of the swirler inside a cylindrical hole, with the further advantage of reducing to minimum the likelihood of jamming because pulps or filaments that are stuck can free themselves more easily.

Furthermore, the position of the swirler directly in contact with the lower end of shutter 4 above avoid pulps, cells or filaments from remaining astride the crests of the helixes, finding no horizontal surface with which to get caught. While maintaining the efficiency of the systems traditionally applied to the filling of clear juices, the aforesaid conformation of the deflection system advantageously allows beverages with a high content of pulps and filaments to pass through.

The helixes of swirler 6 are advantageously dimensioned so that the helical pipes 13 are such to pass pulps of maximum size contained in the product, the helix development is such to radially collect the liquid and again radially release it into the bottle once the required rotational component has been impressed to the liquid itself.

In order to obtain this, a preferred variant includes a helix pitch equal to approximately 1.5-2.5 times the height of swirler 6, preferably equal to double said height. The either conical or cylindrical swirler may include six helixes having a pitch of 36 mm, for example.

The swirler size is also dictated by the conformation of the surrounding valve components, as they have precise dimensions according to the diameter of the outlet hole of valve 1, e.g. 20 mm, and to the height of the lower end part of the valve, which part varies according to the size of the bottle to be filled. With regards to material, the swirler may be made of plastics or stainless steel, for example.

Swirler 6 is mounted on a first portion of the beak 17, internally provided with a channel forming the end part of pipe 8, said beak 17 being inserted and fixed to the shutter 4 at a first end, while its length is such that the second end thereof is adapted to extend into a container to be filled only for the segment corresponding to a portion of the container neck.

Figure 3:
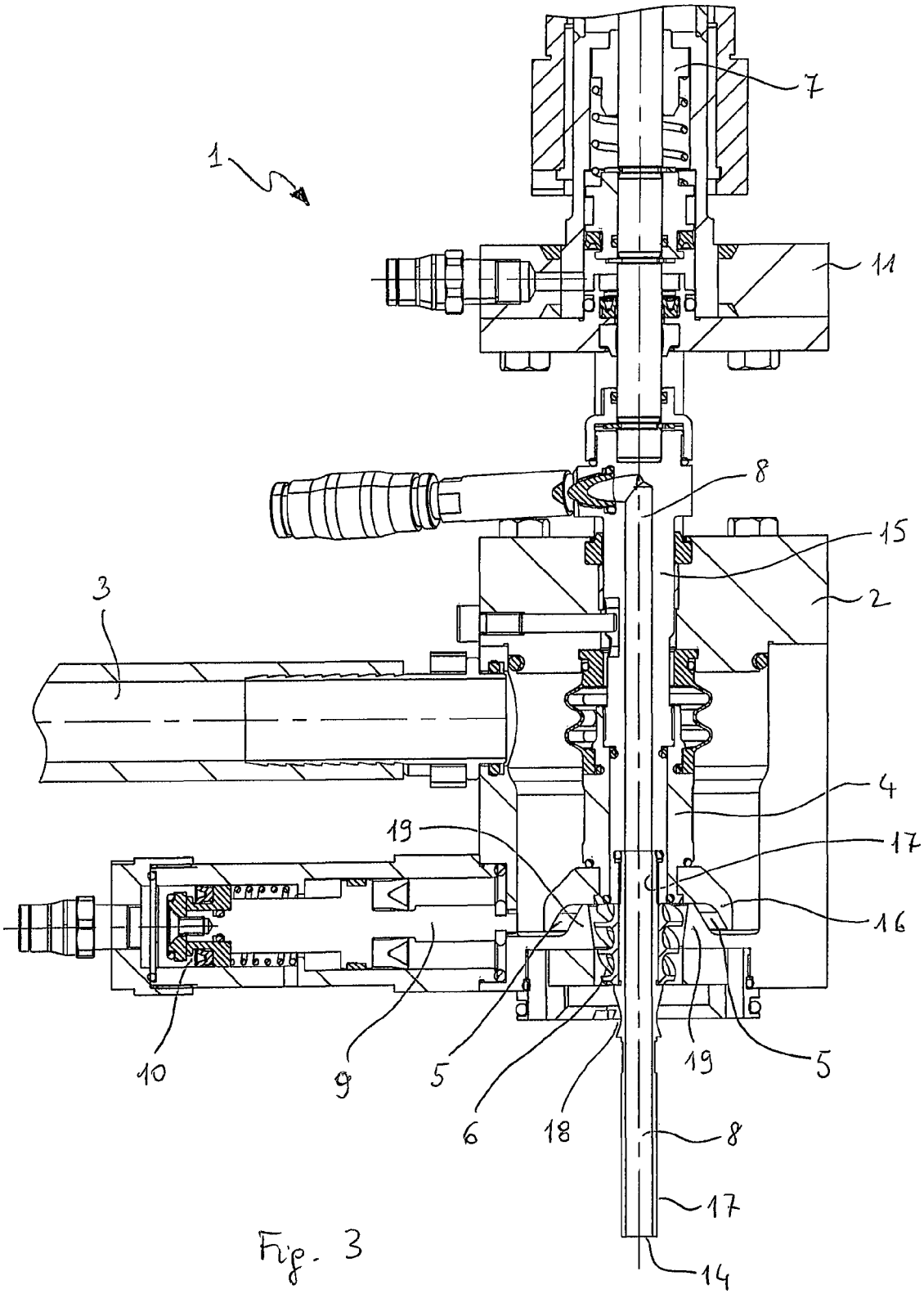
FIG. 3 is a partial enlargement of the view in FIG. 2.
Figure 4:
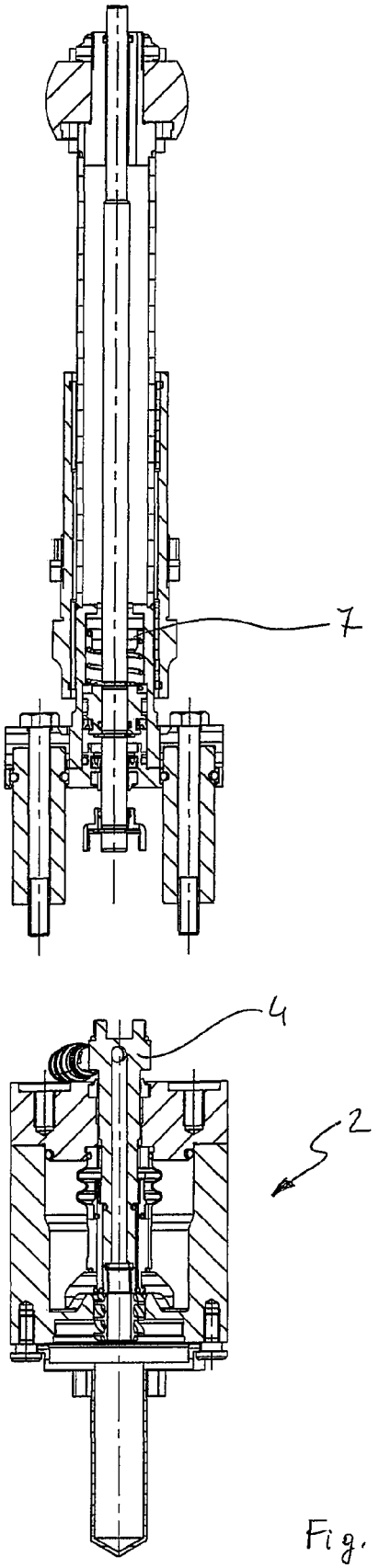
FIG. 4 is a second section view of the filling valve split into two parts.

Being adjacent to and underneath the first portion arranged for assembling the swirler 6, beak 17 has a second portion having a predetermined external profile 18 characterized by a first segment converging towards the axis of pipe 8 and a second segment diverging towards said axis. These two external profile segments are substantially truncated cone-shaped and smoothly joined together, as shown in FIG. 3.

This particular configuration serves an anti-capillary function, i.e. it facilitates the detachment from the beak 17 of the liquid let out from the helical pipes 13 of swirler 6 so as to divert all the liquid towards the internal surface of the bottle thus avoiding a greater formation of foam when filling and the interference of the liquid nappe, which would flow along the beak 17 to the inlet section 14, with regards to a return air flow from the bottle which could cause a slowing down of the steps of filling.

Swirler 6 is entirely arranged within the valve body 2, while the external profile segment 18 of the beak may be either completely or partially inside or completely outside the valve body 2. This swirler configuration avoids problems of product leakage with consequent fouling of the mouth exterior and subsequent formation of moulds in the gaps between capsule and bottle, or particularly in the case of small diameter necks, problems of final level lowering related to the emersion of the deflection system from within the bottle as in the known systems.

Advantageously, the length of beak 17 is such that when the filling valve is lowered onto the bottle to be filled, the second end of the beak extends into the bottle only by a segment corresponding to an initial segment of the neck. This allows to obtain:

- a higher filling level as compared to the solutions of the prior art, very close to the brim, thus making the thermal treatment of the so-called "head space" very effective,
- the generation of less foam and a more rapid evacuation thereof,
- a minimum reduction of active liquid passage sections, and thus a lower piezo load is required, which causes strains which are easily sustainable also by thin plastic bottles.

The particular configuration of pipe 8 allows the liquid inside the pipe to be discharged into the recovery pipe 12 instead of into the bottle, thus allowing to reduce dripping and improve level accuracy: this effect is due to the physically lower position of the outlet section 13 of pipe 8, i.e. the end section close to the recovery pipe 12, with respect to the inlet section 14 of the same pipe 8, i.e. the end section close to the filling portion of the bottle, which condition creates a piezo load favorable to completely discharging the liquid inside the pipe 8 into the recovery pipe 12.

FIGS. 7*a* to 7*f* show different steps of hot filling a bottle according to the present invention.

Figure 7C:
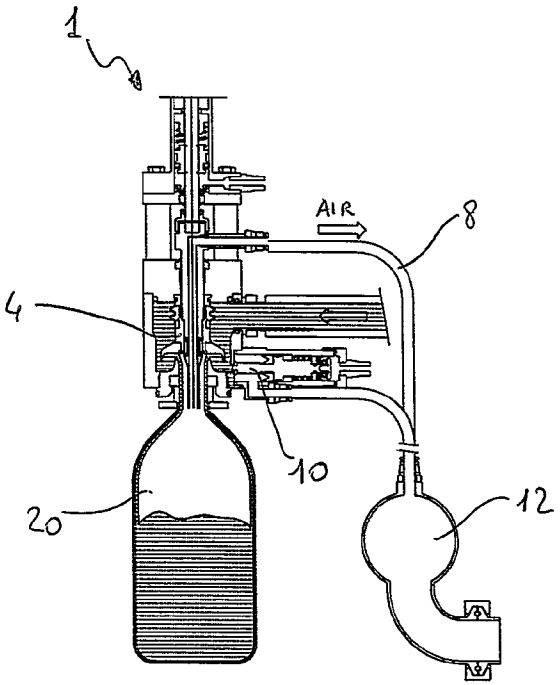
FIGS. 7*a* to 7*f* show different steps of the hot filling process.
Figure 7B:
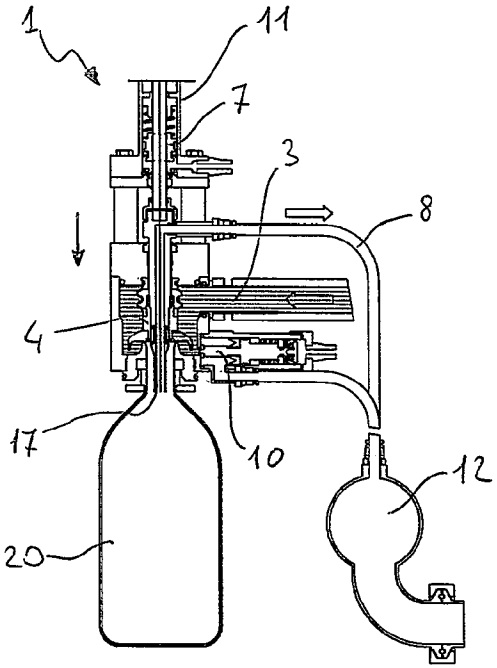
Figure 7A:
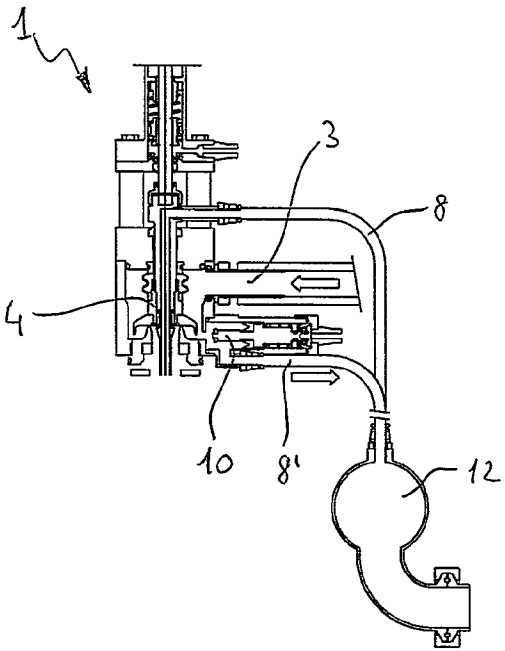
Figure 7F:
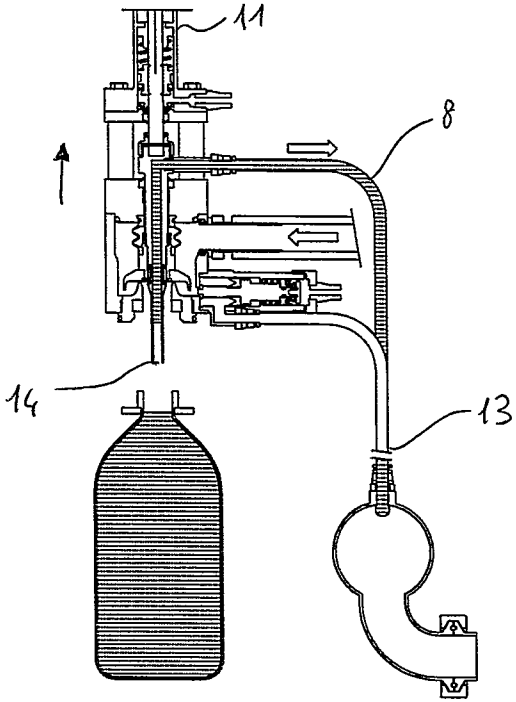
Figure 7E:
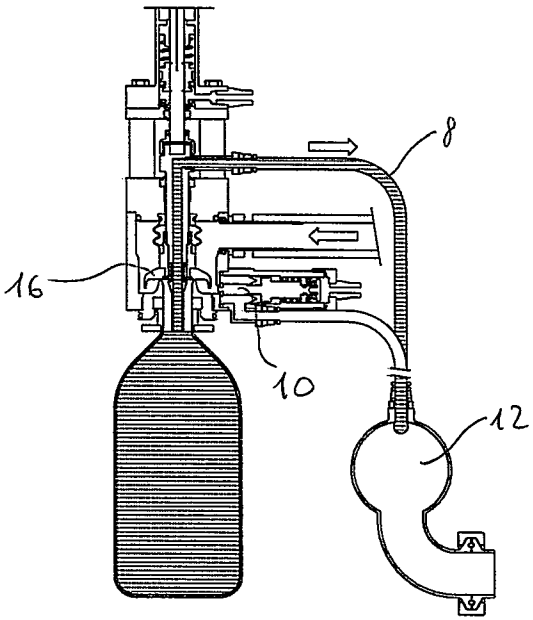

1) Before starting the step of filling the bottle (FIG. 7*b*), a step of heating the filling machine and thus the filling valves 1 is included, firstly carried out with hot water and then with the hot product to be bottled, which are circulated in the valve (FIG. 7*a*). During this step of heating, first the hot water and then the product at certain temperatures reach the valve body 2 through the flexible pipe 3, in which the shutter 4 is lowered thus closing the filling valve, while the shutter 10 is in a retracted position allowing the hot water and hot product to pass into the recirculation pipe 8' connected to the recovery pipe 12. Water let out from pipe 8' is let out from the system.

The purpose of the passage of this first part of product is to suppress residual hot water and to maintain the desired temperature inside the valve body 2. This first part of product let out from pipe 8' is also let out from the system.

2) At a predetermined instant, a bottle 20 is taken to a position underneath a filling valve 1 by a loading drum. Valve 1 is thus lowered by carriage 11 so as to fit on the bottle 20 with the beak 17 partially inside the bottle itself (FIG. 7*b*). Shutter 10 is actuated by actuator 9 to close the recirculation valve 1' and the bottle travels along a first predetermined angle K along the filling roundabout.

3) At this point, with the recirculation valve 1' being closed, the step of filling the bottle 20 starts, in which shutter 4 is lifted by actuator 7, thus opening the filling valve and allowing the product to pass through the siphon 5 along the helical pipes of swirler 6 and then along the bottle walls (FIG. 7*c*). During the step of filling, air is let out from the bottle by means of pipe 8 and the bottle travels a second predetermined angle Y along the filling roundabout.

Figure 7D:
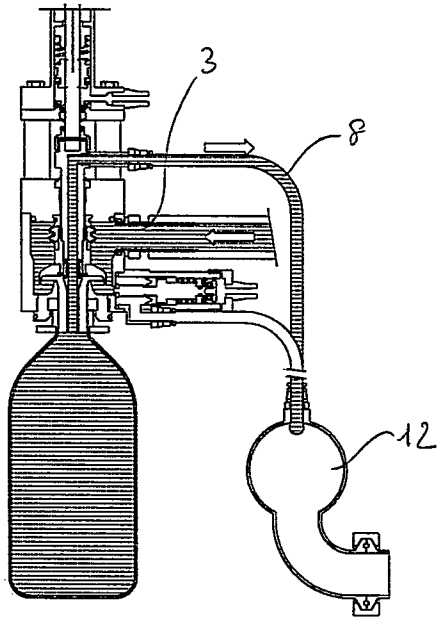

4) Once the filling level has been reached, having a height corresponding to that of the lower end of beak 17, the step of recirculating the product in the bottle starts for letting out the foam and a predetermined amount of product from the bottle 20, which product is introduced through pipe 8 into the recovery pipe 12 and then mixed with new product and subjected to second pasteurization (FIG. 7*d*). During the step of in-bottle recirculating, the bottle travels along a third predetermined angle X along the filling roundabout.

5) At a predetermined instant, at the end of the step of recirculating with an amount of recirculated product equal to maximum 10% of the bottled product, shutter 4 is lowered thus closing the filling valve 1 (FIG. 7*e*) and valve 1 is raised by means of carriage 11 (FIG. 7*f*) so as to release itself from the bottle 20, full of product, which is coupled to an unloading drum.

Steps of sanitizing, i.e. steps of cleaning and sterilizing the machine, are periodically contemplated, at each change of product to be bottled or after a given number of hours of machine operation, including appropriate solutions recirculating in the valve, by using a dummy bottle 30 fixed to valve 1.

Figure 8:
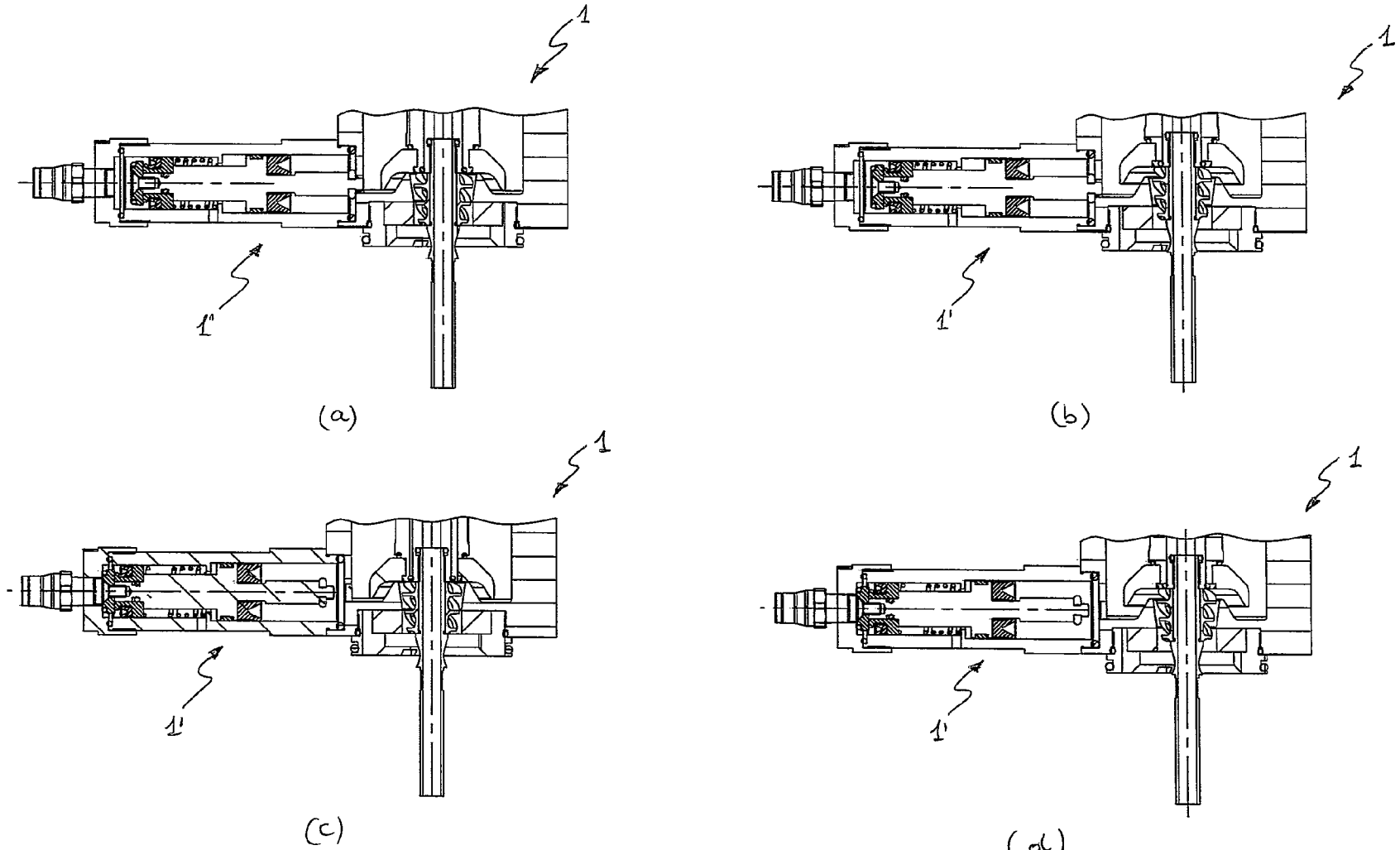
FIG. 8 shows four operation steps of the valve according to the invention.

FIG. 8 shows four operating modes of the filling valve of the invention.

In FIG. 8*a*, both the filling valve 1 and the associated recirculation valve 1' are closed: such a situation occurs when valve 1 is lowered onto the bottle 20 before the step of filling.

In FIG. 8*b*, the filling valve 1 is open while the recirculation valve 1' is closed: such a situation occurs during the steps of filling and in-bottle recirculating.

In FIG. 8*c*, the filling valve 1 is closed while the recirculation valve 1' is open: such a situation occurs during the step of heating and during extended machine stops when the filling valves are released from the bottles.

In FIG. 8*d*, both the filling valve 1 and recirculation valve 1' are open: such a situation occurs during extended system stops. The step of in-valve recirculating should indeed be activated to avoid the system from cooling down, in particular the product close to the closed valves waiting for being bottled, because the step of in-bottle recirculating avoid the product in the previously filled bottles from cooling down before being capped, which event would cause the bottles to be rejected. Maintaining the recirculation valve 1' also open prevents strains capable of compromising the dimensional stability of bottles or containers as high temperature tends to reduce the strength thereof.

Figure 9:
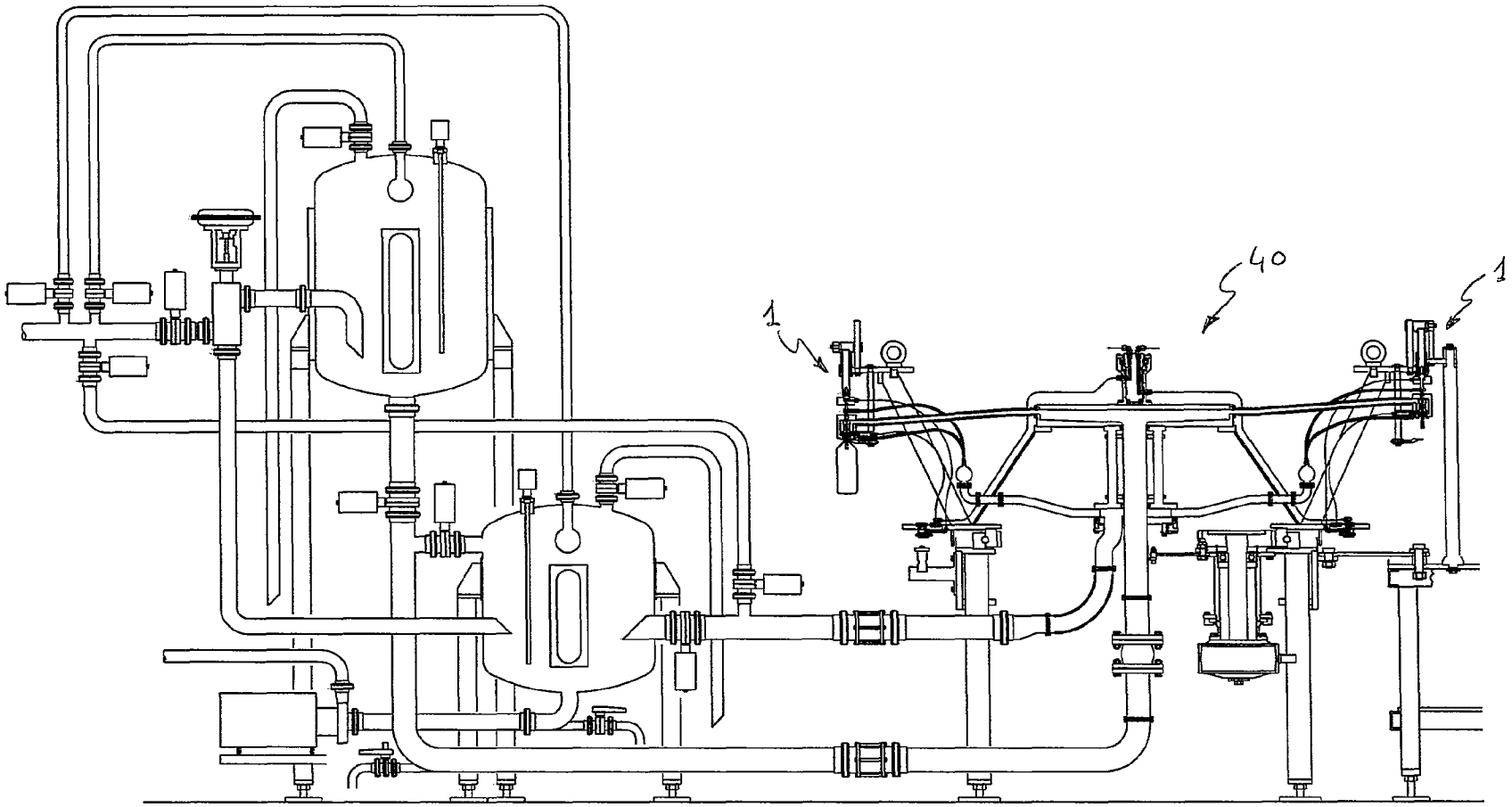
FIG. 9 shows a bottle filling system comprising filling valves according to the invention.

During the steps of sanitizing, the opening of shutters 4, 10 may be postponed and intermittent so as to efficiently wash the product from all concerned circuit. FIG. 9 shows a bottle filling system comprising a filling roundabout 40 provided with one or more filling valves 1 according to the present invention.

In order to improve the final product quality, the adjustment of the amount of product recirculated in the bottle is advantageously determined by the opening delay of the filling valve 1 along the filling roundabout 40, with the closing point of valve 1 being fixed along said roundabout, in order to minimize the amount according to the type of product, the type of bottle and the production rate each time.

Therefore, once the position of the closing runner of valve 1 along the machine periphery has been fixed, the position of the opening runner of valve 1 is determined each time for each product and/or size to be filled.

In practice, the opening point of valve 1 along the roundabout 40 is determined by working back from the fixed closing point so as to allow the bottle to be completely filled and the foam formed during the filling itself to be completely evacuated; thereby, the percentage of recirculated product is reduced to the minimum.

Figure 10:
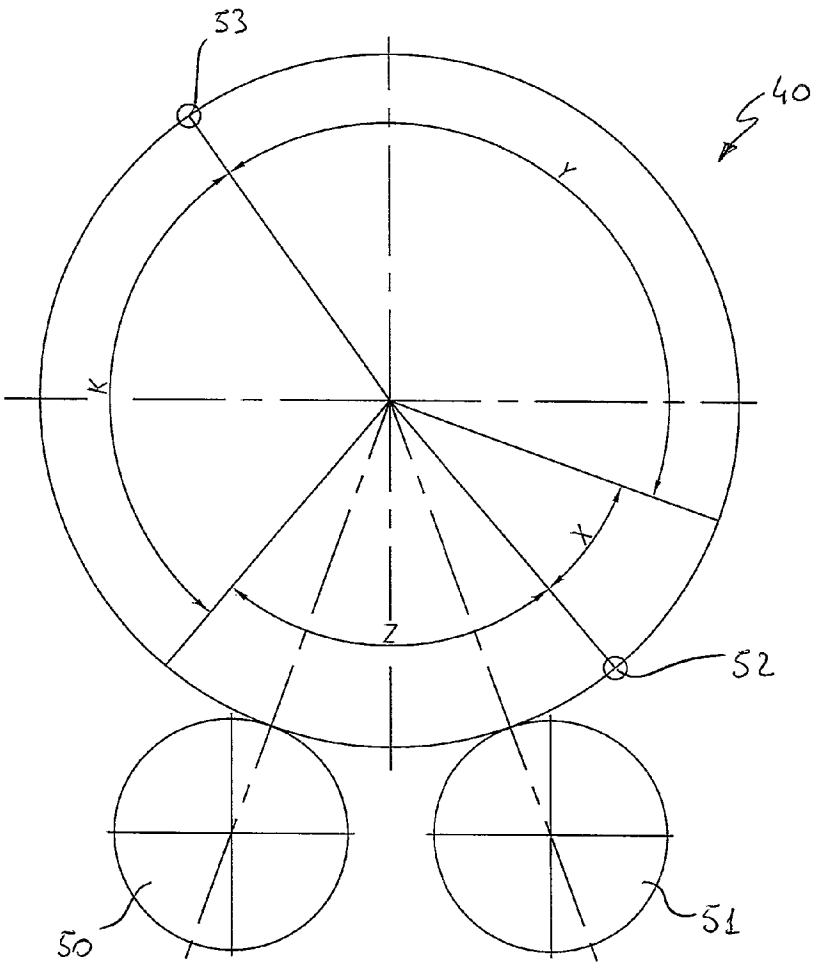
FIG. 10 shows a diagram of the filling roundabout in which the angles related to the various steps of the bottling process are highlighted.

FIG. 10 depicts a diagram of the filling roundabout 40 which shows: the loading drum 50 and the unloading drum 51 of the containers; the predetermined position of the closing point 52 of the filling valve; the (variable) position of the opening point 53 of said valve; the filling angle Y corresponding to the roundabout arc along which the container is completely filled; the recirculation angle X corresponding to the roundabout arc along which the product is recirculated in the bottle to suppress the foam; the angle Z corresponds to the arc along which a cam acts for lifting and lowering the valve 1; and the angle K equal to (360°−X−Y−Z) which determines the opening position 53 of valve 1.

Once a maximum percentage of 10% of recirculation product has been fixed as maximum tolerated value to prevent compromising the organoleptic qualities of the bottled product, and by indicating with the letter "Q" the product flow rate let out from valve 1 during the step of filling (angle Y) and with letter "q" the maximum product flow rate let out from valve 1 during the step of recirculating (angle X), the maximum angle X of the machine at which the product recirculates is $X_{max}$=0,1*Y*(Q/q).

With the filling time for a given product in a given bottle being known (defined in laboratory tests), the machine angle concerned by the step of filling (angle Y) is obtained; and with the filling-recirculating flow rate ratio Q/q of the single valve being known, the maximum angle X of the machine concerned by the step of recirculating, and thus the angle K and the opening position 53 are so obtained. In practice, the recirculation percentage will be closer to the maximum value for small bottles (e.g. 500 ml) with narrow neck and product with a high content of pulps (e.g. 100% juice product), while it will be closer to the minimum value for large bottles (e.g. 2000 ml) with wide neck and clear product (e.g. isotonic beverage).

In general, the longer the filling time, the closer the opening point of the valve to the loading drum 50.

The invention claimed is:

1. A filling valve for filling containers, comprising:

a valve body defining therein a space for passage of a filling liquid and provided with a hole for introducing said liquid in one of said containers, and with a tubular element, passing through said hole, defining an extension of an evacuation pipe comprising an inlet section; a first shutter of said hole, sliding within the valve body;

a recirculation valve acting in cooperation with said valve body, the recirculation valve comprising a second shutter with a corresponding actuator for fully draining a siphon at an end of washing procedures, said second shutter positioned at a bottom level of the siphon;

wherein said first shutter is provided on a first end thereof with an hat-shaped sealing element suited to fluid-tightly close the hole and configured so as to define, in cooperation with an annular protrusion of a bottom of the valve body, the siphon between said space and said hole, for controlling a filling level of the liquid in one of said containers;

wherein a liquid deflection element is accommodated in said hole, configured so as to confer a rotational component to the liquid which crosses it, which permits the liquid itself to adhere to walls of the container during a step of filling, said deflection element being integrally fixed to and directly in contact with said first end of the first shutter;

wherein said evacuation pipe is integrated in the first shutter in order to evacuate air contained in the container during the step of filling and to recirculate the liquid at the end of the filling step.

2. The filling valve according to claim 1, wherein said deflection element is a swirler provided with a plurality of helical pipes.

3. The filling valve according to claim 2, wherein said swirler can have either a conical or a cylindrical external envelope.

4. The filling valve according to claim 3, wherein the swirler comprises helixes having a pitch equal to approximately 1.5-2.5 times the height of the swirler itself.

5. The filling valve according to claim 3, wherein said swirler is arranged entirely inside the valve body.

6. The filling valve according to claim 5, wherein said swirler is mounted on a first portion of a tubular element, and the length of said tubular element is such that the second end thereof is suitable to extend into a container to be filled only for a segment corresponding to a portion of the neck of the container.

7. The filling valve according to claim 6, wherein the tubular element, adjacent to said first portion presents a second portion having a profile with a first converging segment and a second segment diverging towards the axis of the evacuation pipe.

8. The filling valve according to claim 1, wherein, in use, said inlet section is arranged higher than the position of an outlet section provided inside the filling valve in proximity of a recovery pipe for recovering recirculated liquid.

9. The filling valve according to claim 8, wherein the valve body is provided with an inlet pipe for the filling fluid and the recirculation valve comprising the second shutter with the corresponding actuator allows for the recirculation in the filling valve, during the steps of heating and maintaining the temperature when the system is stopped.

10. The filling valve according to claim 9, wherein said recirculation valve is associated to a recirculation pipe connected to said recovery pipe.

11. The filling valve according to claim 10, wherein the first shutter can be actuated by a corresponding actuator integrated, inside a carriage for moving the filling valve.

12. The tilling valve according to claim 11, wherein said hole is conical or frustoconical or cylindrical or frustoconical-cylindrical.

13. A filling system of containers comprising one or more filling valves according to claim 1.

14. A filling method of a container with a filling liquid by means of a filling valve according to claim 9, comprising the steps of:

heating the valve body of the filling valve by means of a passage in the space of said valve body firstly of hot water and then of filling liquid at a predetermined temperature, maintaining the second shutter in opening position and the first shutter in closing position;

taking the second shutter to closing position;

taking the first shutter to opening position and filling the container with the filling liquid to reach a bottled liquid volume corresponding to a level determined by the position of the inlet section of the evacuation pipe, with a consequent evacuation of air through said evacuation pipe;

further filling the container so as to make the filling liquid recirculate in the container with a consequent evacuation of a volume portion of said bottled liquid volume through the evacuation pipe;

taking the first shutter to a closing position at a predetermined instant so that said volume portion is equal to no more than 10% of the bottled liquid volume.

* * * * *

UNITED STATES PATENT AND TRADEMARK OFFICE

CERTIFICATE OF CORRECTION

PATENT NO. : 9,108,834 B2
APPLICATION NO. : 13/138401
DATED : August 18, 2015
INVENTOR(S) : Pasquale Mauro, Stefano Abati and Matteo Zoppas It is certified that error appears in the above-identified patent and that said Letters Patent is hereby corrected as shown below:

Title page, column 1, lines (10-14), the portion reading "(*) Notice: Subject to any disclaimer, the term of this patent is extended or adjusted under 35 U.S.C. 154(b) by 848 days. This patent is subject to a terminal disclaimer." should be deleted.

Title page, column 2, line (2), the portion reading "Date of Patent: *Aug. 18, 2015" should read --Date of Patent: Aug. 18, 2015--.

Signed and Sealed this
Ninth Day of February, 2016

Michelle K. Lee

Michelle K. Lee
*Director of the United States Patent and Trademark Office*